US010408014B1

(12) United States Patent
Sun et al.

(10) Patent No.: US 10,408,014 B1
(45) Date of Patent: Sep. 10, 2019

(54) WELL KILLING METHOD AND DEVICE FOR A FRACTURED FORMATION WITHOUT SAFETY PRESSURE WINDOW BY FIVE-STEP BULLHEADING

(71) Applicant: China University of Petroleum (East China), Qingdao (CN)

(72) Inventors: Baojiang Sun, Qingdao (CN); Xueqing Teng, Korla (CN); Yaoming Zhang, Korla (CN); Zhiyuan Wang, Qingdao (CN); Hongtao Liu, Korla (CN); Jianbo Zhang, Qingdao (CN); Youqiang Liao, Qingdao (CN)

(73) Assignee: China University of Petroleum (East China), Qingdao (CN)

( * ) Notice: Subject to any disclaimer, the term of this patent is extended or adjusted under 35 U.S.C. 154(b) by 0 days.

(21) Appl. No.: 16/246,860

(22) Filed: Jan. 14, 2019

(30) Foreign Application Priority Data

Dec. 7, 2018 (CN) ..... 2018 1 1497025

(51) Int. Cl.
*E21B 33/138* (2006.01)
*E21B 47/06* (2012.01)

(52) U.S. Cl.
CPC ..... *E21B 33/138* (2013.01); *E21B 47/06* (2013.01)

(58) Field of Classification Search
USPC ..... 166/250.01
See application file for complete search history.

(56) References Cited

U.S. PATENT DOCUMENTS

2017/0081934 A1* 3/2017 Nedwed ..... E21B 33/068
2017/0122046 A1* 5/2017 Vavik ..... E21B 47/06

* cited by examiner

*Primary Examiner* — Taras P Bemko
(74) *Attorney, Agent, or Firm* — Volpe and Koenig, P.C.

(57) ABSTRACT

The well killing device comprises: a first path; a flow regulating device; a pressure detector and a controlling device. The controlling device may control the discharge amount of the killing fluid in different killing stages according to the gas-fluid two-phase flow theory, the pressure of the killing fluid at the wellhead, and the rising speed of the drilling column.

13 Claims, 3 Drawing Sheets

WELL KILLING METHOD AND DEVICE FOR A FRACTURED FORMATION WITHOUT SAFETY PRESSURE WINDOW BY FIVE-STEP BULLHEADING

CROSS REFERENCE TO RELATED APPLICATION

This application claims the benefit of Chinese Patent Application No. 201811497025.1, which was filed Dec. 7, 2018 and is incorporated herein by reference as if fully set forth.

FIELD

The present invention relates to the field of wellbore pressure controlling technology during well drilling, and more specifically, to a well killing method and device for a fractured formation without a safety pressure window.

BACKGROUND

With the development of the economy, China's demand for oil and gas resources has also increased. However, due to the fact that most of the early main oil fields have entered the middle and late stages of development and the crude oil production has not been able to make a major breakthrough, China's oil and gas dependence has reached a record high in recent years. Therefore, China's oil and gas exploration and development are gradually focusing on the complex formations that have not drawn much attention in the early days, such as fractured formations. At present, the fractured reservoirs drilled in China are gradually increasing. The explored geological reserves of fractured oil and gas reservoirs account for 28% of the total explored reserves in the country, and the oil and gas production of fractured reservoirs has exceeded 14 million tons per year. In the future, the oil and gas production of fractured reservoirs will play an increasingly important role in the development of China's petroleum industry.

The fractured formation has a characteristic of pressure sensitivity; the safety drilling pressure window is very narrow, and some fractured reservoirs do not even have a safety pressure window. Under the above circumstances, gas kick is highly prone to occur during a drilling process. Therefore, the problem of well control runs through the entire drilling process of the fractured formation. Once improperly handled, serious accidents such as kicks or blowouts may occur. At present, the methods of treating gas kick are mainly conventional well killing methods such as driller's and engineer's methods. For the gas kick during a drilling process of fractured reservoirs without a safety pressure window, if these conventional well killing methods are used, it is easy to cause the leakage and the concurrence of leakage and blowout. Not only will it not effectively resolve the problem of gas kick or blowout, it may even destroy the reservoir and affect the efficiency of oil and gas resource exploration.

SUMMARY

The invention aims at providing a well killing method and device for a fractured formation without a safety pressure window. The method can greatly reduce the safety risk during the well killing process for a fractured formation without a safety pressure window, thus providing safety for the killing operations.

In order to realize the purpose, a well killing method for a fractured formation without a safety pressure window is provided. The method comprises: controlling a killing fluid to discharge into an annulus between a casing and a drilling column of a well killing device by a first discharge amount based on physical parameters of a intruding gas of the formation and physical parameters of the killing fluid, so that the intruding gas is turned downward by the killing fluid; detecting and transmitting the pressure of the killing fluid at the wellhead in the annulus; determining that the intruding gas is completely pressed back into the formation when the pressure of the killing fluid at the wellhead in the annulus is detected to remain unchanged, and controlling the killing fluid to stop discharging and the drilling column to move upward at a pre-set speed; and controlling the killing fluid to discharge into the annulus by a second discharge amount based on a rising speed of the drilling column during the process of upward movement of the drilling column, so as to maintain the pressure at the bottom of the well.

Optionally, the controlling the killing fluid to stop discharging comprises: controlling the discharge of the killing fluid to reduce by a pre-set regular discharge amount until the discharge is stopped.

Optionally, the first discharge amount $Q_1$ satisfies the following relationship: $v_sA<Q_1<\mathrm{Min}\{Q_{11}, Q_{12}, Q_{13}, Q_{14}\}$, wherein A is a cross-sectional area of the annulus, $Q_{11}$ is a maximum discharge amount of the killing fluid allowed by the killing fluid injecting device at the wellhead; $Q_{12}$ is a maximum discharge amount of the killing fluid allowed by a fracture pressure of a casing shoes; $Q_{13}$ is a maximum discharge amount of the killing fluid allowed by an anti-internal pressure of the casing; $Q_{14}$ is a maximum discharge amount of the killing fluid allowed by the fracture pressure at the bottom of a well;

$$v_s = C\left[\frac{gD(\rho_L - \rho_g)}{\rho_L}\right]^{0.5}$$

is a slippage rising speed of the intruding gas of the formation in the killing fluid, wherein g is a gravitational acceleration, $\rho_L$ is a density of the killing fluid, $\rho_g$ is a density of the intruding gas of the formation, D is a hydraulic diameter of the annulus and C is a constant.

Optionally, the constant C can be calculated via a Barnea model, $$C = 0.1725[(\pi + 1) + K(\pi - 1)]^{0.5},\ K = \frac{D_{to}}{D_{ci}},$$

wherein $D_{to}$ is an outer diameter of the drilling column; $D_{ci}$ is an inner diameter of the casing.

Optionally, the second discharge amount $Q_2$ satisfies the following relationship: $Q_2=Q_{21}+Q_{22}+Q_{23}$, wherein, $Q_{21}$ is the amount of the killing fluid to be replenished due to an upward movement of the drilling column which causes fluid level in the annulus to be reduced; $Q_{22}$ is the amount of the killing fluid to be replenished due to a leakage of the killing fluid into the fracture of the formation; and $Q_{23}$ is the amount of the killing fluid to be replenished due to a twitching effect caused by the upward movement of the drilling column.

Optionally, the $Q_{21}$ and the $Q_{23}$ are respectively determined by: $Q_{21}=\frac{1}{4}\pi D_{to}^2 v_p$, $$Q_{23} = \frac{1}{2} f v_p^3 \frac{\pi(D_{ci} + D_{to})}{4g},$$

wherein $v_p$ is the rising speed of the drilling column; $D_{to}$ is an outer diameter of the drilling column; $D_{ci}$ is an inner diameter of the casing; f is a friction coefficient of the killing fluid; and the $Q_{22}$ is related to a viscosity $\mu_L$ of the killing fluid, a density ρ of the killing fluid, a width W of the fracture and a pressure difference Δp between the bottom of a well and the formation at the same level as the bottom of the well.

Optionally, further comprising: injecting a drilling fluid containing a plugging material into a fracture of the formation under the circumstances where the drilling column moves upward to a pre-determined position below a casing shoes.

Accordingly, a well killing device for a fractured formation without a safety pressure window is also provided. The well killing device comprises a drilling column and a casing, with an annulus formed between the casing and the drilling column, the well killing device further comprises: a first path for injecting killing fluid into the annulus; a flow regulating device for controlling a discharge amount of the killing fluid; a pressure detector for detecting and transmitting a pressure of the killing fluid at the wellhead in the annulus; a controlling device for performing the following operations: controlling the flow regulating device to discharge the killing fluid into the annulus by a first discharge amount through the first path based on physical parameters of a intruding gas of the formation and physical parameters of the killing fluid, so that the intruding gas is turned downward by the killing fluid; determining that the intruding gas is completely pressed back to the formation when the pressure of the killing fluid at the wellhead in the annulus is detected to remain unchanged, and controlling the killing fluid to stop discharging and the drilling column to move upward at a pre-set speed; controlling the killing fluid to discharge into the annulus by a second discharge amount based on a rising speed of the drilling column during the process of upward movement of the drilling column, so as to maintain the pressure at the bottom of the well.

Optionally, the controlling device is further used for controlling the flow regulating device to reduce the discharge amount of the killing fluid by a pre-set regular discharge amount until the discharge is stopped.

Optionally, the first discharge amount $Q_1$ should satisfy the following relationship: $v_s A < Q < \mathrm{Min}\{Q_{11}, Q_{12}, Q_{13}, Q_{14}\}$, wherein A is a cross-sectional area of the annulus, $Q_{11}$ is a maximum discharge amount of the killing fluid allowed by the killing fluid injecting device at the wellhead; $Q_{12}$ is a maximum discharge amount of the killing fluid allowed by a fracture pressure of a casing shoes; $Q_{13}$ is a maximum discharge amount of the killing fluid allowed by an anti-internal pressure of the casing; $Q_{14}$ is a maximum discharge amount of the killing fluid allowed by the fracture pressure at the bottom of a well;

$$v_s = C\left[\frac{gD(\rho_L - \rho_g)}{\rho_L}\right]^{0.5}$$

is a slippage rising speed of the intruding gas of the formation in the killing fluid, wherein g is a gravitational acceleration, $\rho_L$ is a density of the killing fluid, $\mu_g$ is a density of the intruding gas of the formation, D is a hydraulic diameter of the annulus and C is a constant.

Optionally, the constant C can be calculated via a Barnea model, $$C = 0.1725[(\pi + 1) + K(\pi - 1)]^{0.5},\ K = \frac{D_{to}}{D_{ci}},$$

wherein $D_{to}$ is an outer diameter of the drilling column; $D_{ci}$ is an inner diameter of the casing.

Optionally, the second discharge amount $Q_2$ satisfies the following relationship: $Q_2 = Q_{21} + Q_{22} + Q_{23}$, wherein, $Q_{21}$ is the amount of the killing fluid to be replenished due to an upward movement of the drilling column which causes fluid level in the annulus to be reduced; $Q_{22}$ is the amount of the killing fluid to be replenished due to a leakage of the killing fluid into the fracture of the formation; and $Q_{23}$ is a amount of the killing fluid to be replenished due to a twitching effect caused by the upward movement of the drilling column.

Optionally, the $Q_{21}$ and the $Q_{23}$ are respectively determined by:

$$Q_{21} = \frac{1}{4}\pi D_{to}^2 v_p,\ Q_{23} = \frac{1}{2} f v_p^3 \frac{\pi(D_{ci} + D_{to})}{4g},$$

wherein $v_p$ is the rising speed of the drilling column; $D_{to}$ is an outer diameter of the drilling column; $D_{ci}$ is an inner diameter of the casing; f is a friction coefficient of the killing fluid; and the $Q_{22}$ is related to a viscosity $\mu_L$ of the killing fluid, a density ρ of the killing fluid, a width W of the fracture and a pressure difference Δp between the bottom of a well and the formation at the same level as the bottom of the well.

Optionally, further comprising: a second path used for injecting a drilling fluid containing a plugging material into the drilling column; the controlling device is further used for controlling the drilling fluid containing a plugging material to inject into a fracture of the formation on condition that the drilling column moves upward to a pre-determined position below a casing shoes.

Optionally, the flow regulating device is a fluid injection pump, and the controlling device is further used for controlling the discharge amount of the killing fluid by way of regulating the pump strokes of the fluid injection pump.

Through the technical scheme, the invention creatively controls the discharge amount of the killing fluid in different killing stages according to the gas-fluid two-phase flow theory, the pressure of the killing fluid at the wellhead, and the rising speed of the drilling column, so as to effectively reduce the safety risk in a well killing process for a fractured formation without a safety pressure window, thus providing safety for a killing operation.

Other features and advantages of the invention will be described in detail in the following embodiment.

BRIEF DESCRIPTION OF THE DRAWINGS

The accompanying drawing is used for further understanding of example of implementation of the invention and constitutes a portion of the specification. The accompanying drawing, together with the following embodiment, is used for explaining example of implementation of the invention, but does not limit example of implementation of the invention. In the accompanying drawing.

FIG. 4 is the view from which the sectional view of FIG. 3 was taken, and the plane upon which the section view was taken is indicated by a broken line. The direction of view in FIG. 3 is indicated by the Arrows 3 in FIG. 4.

Instructions of marks of the accompanying drawing:

| | | | |
|---|---|---|---|
| 1 | drilling column | 2 | blowout preventer stack |
| 3 | Casing | 4 | killing manifold |
| 6 | flow meter | 7 | casing pressure gauge |
| 8 | check valve | 9 | killing manifold branch valve |
| 10 | mud line branch valve | 11 | three-way control valve |
| 12 | casing shoes | 13 | killing fluid |
| 14 | drilling fluid | 15 | intruding gas |
| 16 | back-pressure valve | 17 | fracture |
| 18 | formation | 19 | driller body |
| 20 | fracturing train | 21 | instrument truck |
| 22 | fluid supply truck | 23 | mud pump |
| 24 | mud pool | 25 | second path |
| 26 | flow meter | 27 | third path |
| 28 | first path | 101 | flow controlling device |
| 102 | pressure tester | 103 | controlling device |

DETAILED DESCRIPTION OF EMBODIMENTS

The embodiment of example of implementation of the invention is described in detail by combining with the accompanying drawings. What shall be understood is that the embodiment described here is only used for explaining and illustrating example of implementation of the invention, but does not limit the example of implementation of the invention.

In view of the gas kick during a process of drilling a fractured formation without a safety pressure window, the present invention employs an unconventional well killing method, namely the bullheading, to kill a well. The bullheading is a process of pumping the killing fluid into a well, pressing the formation intruding fluid back into a permeable formation along the original path, and using the hydrostatic column pressure of the killing fluid to re-balance the formation pressure. The bullheading can be divided into a forward extrusion and a backward extrusion, wherein, the forward extrusion refers to extruding the formation fluid which invades a drilling column back into the formation by way of pumping the killing fluid into the drilling column; the backward extrusion refers to extruding the formation fluid which intrudes the annulus back into the formation by way of injecting the killing fluid into the annulus between the drilling column and the casing. The present invention describes in detail the use of a backward-extruding well killing method for a fractured formation without a safety pressure window.

Figure 1:
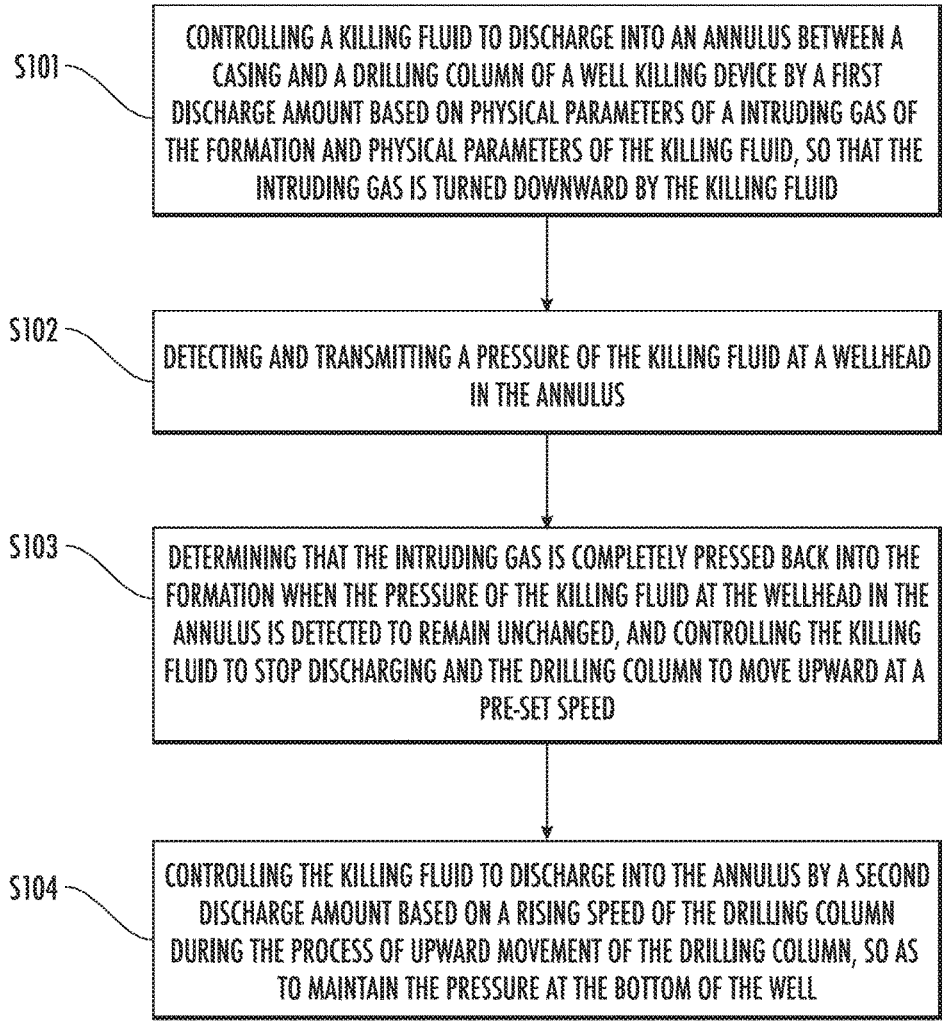
FIG. 1 is a flow chart of a well killing method for a fractured formation without a safety pressure window according to an embodiment of the present invention.

FIG. 1 is a flow chart of a well killing method for a fractured formation without a safety pressure window according to an embodiment of the present invention. As shown in FIG. 1, the well killing method for a fractured formation without a safety pressure window provided in the present invention may comprise: Step S101, controlling a killing fluid to discharge into an annulus between a casing and a drilling column of a well killing device by a first discharge amount based on physical parameters of the intruding gas of the formation and physical parameters of the killing fluid, so that a intruding gas is turned downward by the killing fluid; Step S102, detecting and transmitting a pressure of the killing fluid at a wellhead in the annulus; Step S103, determining that the intruding gas is completely pressed back to the formation when the pressure of the killing fluid at the wellhead in the annulus is detected to remain unchanged, and controlling the killing fluid to stop discharging and the drilling column to move upward at a pre-set speed; and Step S104, controlling the killing fluid to discharge into the annulus by a second discharge amount based on a rising speed of the drilling column during the process of upward movement of the drilling column, so as to maintain the pressure at the bottom of the well. The killing device creatively controls the discharge amount of the killing fluid in different killing stages according to the gas-fluid two-phase flow theory, the pressure of the killing fluid at the wellhead, and the rising speed of the drilling column, so as to effectively reduce the safety risk in a well killing process for a fractured formation without a safety pressure window, thus providing safety for a killing operation.

According to the theory of gas-fluid two-phase flow, the gas has a slippage rising speed in a fluid. In a process by way of the bullheading, the purpose of turning the intruding gas downward can be achieved only when the downward flow speed of the killing fluid is greater than the slippage rising speed of the intruding gas.

In Step S101, the physical parameter of the intruding gas of the formation may comprise a density $\rho_g$ of the intruding gas of the formation, and the physical parameter of the killing fluid may comprise a density $\rho_L$ of the killing fluid; according to the densities of the intruding gas and the killing fluid, it is determined that the slippage rising speed of the intruding gas in the killing fluid satisfies the following equation:

$$v_s = C\left[\frac{gD(\rho_L - \rho_g)}{\rho_L}\right]^{0.5},$$

wherein g is a gravitational acceleration; D is the hydraulic diameter of the annulus; and C is a constant. The constant C can be calculated via a Barnea model, $$C = 0.1725[(\pi + 1) + K(\pi - 1)]^{0.5},\ K = \frac{D_{to}}{D_{ci}},$$

wherein $D_{to}$ is the outer diameter of the drilling column; $D_{ci}$ is the inner diameter of the casing. In order to change the direction of the movement of the intruding gas from an upward movement to a downward movement, and to ensure that the killing device is not damaged, it is necessary to discharge the killing fluid into the annulus between the casing of the killing device and the drilling column by a first discharge amount, wherein the first discharge amount $Q_1$ should satisfy the following relationship: $v_sA<_Q<\text{Min}\ \{Q_{11}, Q_{12}, Q_{13}, Q_{14}\}$, wherein A is the cross-sectional area of the annulus, $Q_{11}$ is the maximum discharge amount of the killing fluid allowed by the killing fluid injecting device at the wellhead; $Q_{12}$ is the maximum discharge amount of the killing fluid allowed by the fracture pressure of the casing shoes; $Q_{13}$ is the maximum discharge amount of the killing fluid allowed by the anti-internal pressure of the casing; $Q_{14}$ is the maximum discharge amount of the killing fluid allowed by the fracture pressure at the bottom of a well. The simultaneous change of the frictional direction during the turning process of the intruding gas results in the highest pressure of the killing fluid at the wellhead at this time; therefore, it is necessary to monitor the pressure change of the killing fluid at the wellhead in real time (for example, via a casing pressure gauge), to ensure that it does not exceed the pressure bearing capacity of the device (for example, a blowout preventer stack) at the wellhead and 80% of the anti-internal pressure bearing capacity of the casing.

In Step S102, the pressure P of the killing fluid at the wellhead in the annulus during the process of downward movement of the intruding gas may be expressed by the following relationship:

$$P_t = P_{wf} - \rho_a gh + \frac{2\rho_a f v^2 h}{D},$$

wherein $P_{wf}$ is a pressure at the bottom of the well; $\mu_a$ is an average density of the annulus fluid (intruding gas and killing fluid); h is the depth of the well; f is an average friction coefficient of the annulus fluid (intruding gas and killing fluid); v is an average speed of the annulus fluid (intruding gas and killing fluid); D is a hydraulic diameter of the annulus. The intruding gas is determined to be pressed back into the formation in the annulus by way of detecting the change in the pressure (the casing pressure of the annulus) of the killing fluid at the wellhead in the annulus, so as to prevent the intruding gas from turning upward to cause a blowout risk.

In Step S103, during the process of downward movement of the invading gas, the intruding gas is determined to be pressed back into the formation in the annulus by way of monitoring the pressure of the killing fluid at the wellhead in the annulus (the casing pressure of the annulus). Based on the relationship of the above-mentioned casing pressure P of the annulus, as the intruding gas in the annulus is gradually pressed back to the formation, the average density $\mu_a$ of the fluid in the annulus gradually increases, and the pressure $\rho_a gh$ of the hydrostatic column gradually increases, so that the casing pressure of the annulus gradually reduces. When the intruding gas is all pressed back into the formation, the casing pressure of the annulus will be reduced to a certain value and remain unchanged. Therefore, when the pressure of the killing fluid at the wellhead in the annulus is detected to remain unchanged, it is determined that the intruding gas is completely pressed back into the formation and the killing fluid is controlled to stop being discharged and the drilling column is controlled to move upward at a pre-set speed, so as to prepare for injecting the drilling fluid containing a plugging material.

When the discharge of the killing fluid is controlled to be stopped, if the discharge of the killing fluid is suddenly stopped, the killing fluid will continue to flow into the formation since the flow of the killing fluid in the annulus has an inertia, and the fluid level cannot be maintained at the wellhead in the annulus. Then, the pressure at the bottom of the well will be reduced with the leakage of the killing fluid, thus causing the recurrence of the gas kick; therefore, the method of stepwise braking (i.e., the discharge of the killing fluid is gradually reduced) should be adopted to reduce the leakage caused by the inertia of the killing fluid.

Therefore, the controlling the killing fluid to stop discharging may comprise: the discharge of the killing fluid is controlled to be reduced by a pre-set regular discharge amount until the discharge is stopped. For example, the killing fluid is discharged at a uniformly reduced injecting speed until the discharge is stopped.

In Step S104, during the process of upward movement of the drilling column, the reduction of the fluid level in the annulus, the leakage of the killing fluid in the annulus and the twitching effect caused by the upward movement of the drilling column will cause the pressure at the bottom of the well to be reduced; therefore, the hanging irrigation and pressure stabilization is required to be conducted, that is, the drilling column is controlled to move upward alternately at a pre-set interval and the killing fluid is controlled to be discharged into the annulus by a second discharge amount to prevent the recurrence of gas kick. The second discharge amount $Q_3$ satisfies the following relationship: $Q_2=Q_{21}+Q_{22}+Q_{23}$, wherein, $Q_{21}$ is the amount of the killing fluid to be replenished due to the upward movement of the drilling column which causes the fluid level in the annulus to reduce; $Q_{22}$ is the amount of the killing fluid to be replenished due to the leakage of the killing fluid into the fracture of the formation; and $Q_{23}$ is the amount of the killing fluid to be replenished due to the twitching effect caused by the upward movement of the drilling column. The $Q_{21}$ and the $Q_{23}$ are respectively determined by the following relationship, $$Q_{21} = \frac{1}{4}\pi D_{to}^2 v_p,\ Q_{23} = \frac{1}{2} f v_p^3 \frac{\pi(D_{ci} + D_{to})}{4g},$$

wherein $v_p$ is the rising speed of the drilling column, $D_{to}$ is the outer diameter of the drilling column, $D_{ci}$ is the inner diameter of the casing, and f is the friction coefficient of the killing fluid; and the $Q_{22}$ is related to the viscosity $\mu_L$ of the killing fluid, the density ρ of the killing fluid, the width W of the fracture and the pressure difference Δp between the bottom of the well and the formation at the same level as the bottom of the well.

When the drilling column is lifted to the position of the casing shoes, the drilling column is controlled to stop moving.

When the drilling column is lifted to the position of the casing shoes and stops moving, the drilling fluid containing a plugging material is further required to be injected into the formation to increase the pressure bearing capacity of the formation, so as to re-establish a safety pressure window for the drilling, thus laying a foundation for safe drilling after a successful killing. Therefore, the well killing method for a fractured formation without a safety pressure window provided in the present invention may further comprise: the drilling fluid containing a plugging material is injected into a fracture of the formation under the circumstances where the drilling column moves upward to the pre-determined position below the casing shoes. The bridging between the particles of the plugging material seals the fracture and re-establishes a safety pressure window, thus increasing the pressure bearing capacity of the fractured formation; this process is called the plugging for pressure bearing. The safety pressure window established by the plugging for pressure bearing can be expressed by the following formula: $\Delta P_s=P_b-\mathrm{Max}\{P_c, P_P\}$, wherein $\Delta P_s$ is the safety pressure window established by the plugging for pressure bearing, $P_b$ is the formation fracture pressure after the plugging for pressure bearing, $P_c$ is the formation collapsing pressure after the plugging for pressure bearing, and $P_p$ is the formation pore pressure after the plugging for pressure bearing.

The bullheading used in the present invention can inject the killing fluid with different discharges at different stages during the well-pressing process of the fractured formation without a safety pressure window, thus effectively avoiding the blind injection of the killing fluid which may cause the risk of the formation fracture. In addition, a safety pressure window of the well is reconstructed, thus laying a foundation for safe drilling operations after a successful killing. The steps of the method, which are scientific and simple, can effectively improve the success rate of the killing, and provide a theoretical and technical support for killing a fractured formation without a safety pressure window.

Figure 2:
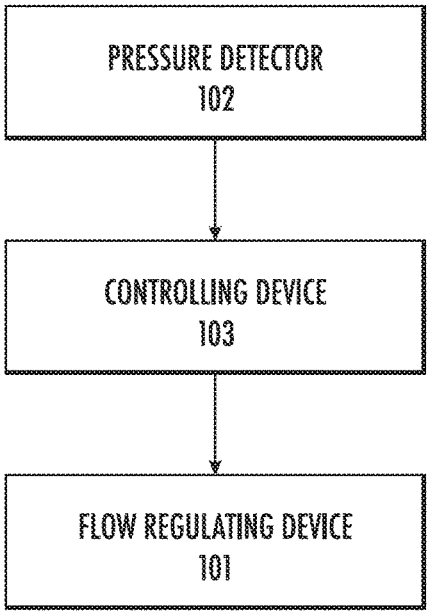
FIG. 2 is a structural view of a well killing device for a fractured formation without a safety pressure window according to an embodiment of the present invention.

Accordingly, as shown in FIG. 2, the present invention further provides a well killing device for a fractured formation without a safety pressure window, wherein the well killing device comprises a drilling column and a casing, with an annulus formed between the casing and the drilling column; the well killing device may further comprise: a first path used for injecting the killing fluid into the annulus, a flow regulating device 101 used for controlling a discharge amount of the killing fluid, a pressure detector 102 used for detecting and transmitting the pressure of the killing fluid at the wellhead in the annulus, and a controlling device 103 used for performing the following operations: is controlling the flow regulating device 101 to discharge the killing fluid into the annulus by a first discharge amount through the first path based on the physical parameters of the intruding gas of the formation and the physical parameters of the killing fluid, so that the intruding gas is turned downward by the killing fluid; when the pressure of the killing fluid at the wellhead in the annulus is detected to remain unchanged, determining that the intruding gas is completely pressed back to the formation, and controlling the killing fluid to stop being discharged and the drilling column to move upward at a pre-set speed; and during the process of upward movement of the drilling column, controlling the flow regulating device 101 to discharge the killing fluid into the annulus by a second discharge amount based on the rising speed of the drilling column, so as to maintain the pressure at the bottom of the well.

Figure 3:
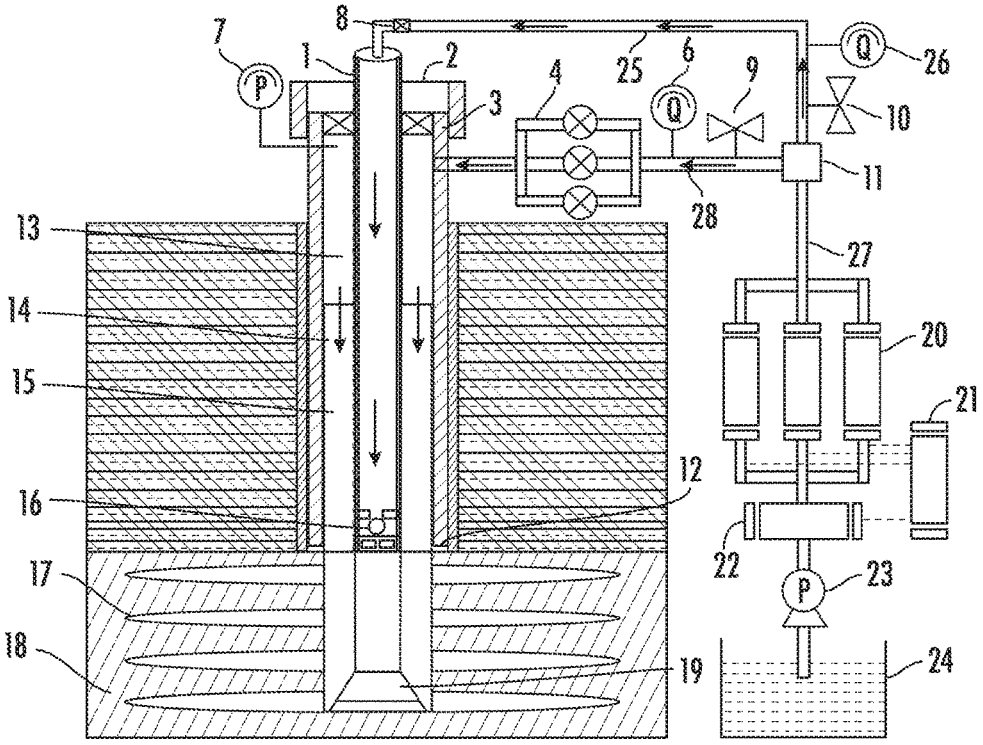
FIG. 3 is a schematic view of a well killing device for a fractured formation without a safety pressure window according to an embodiment of the present invention.
Figure 4:
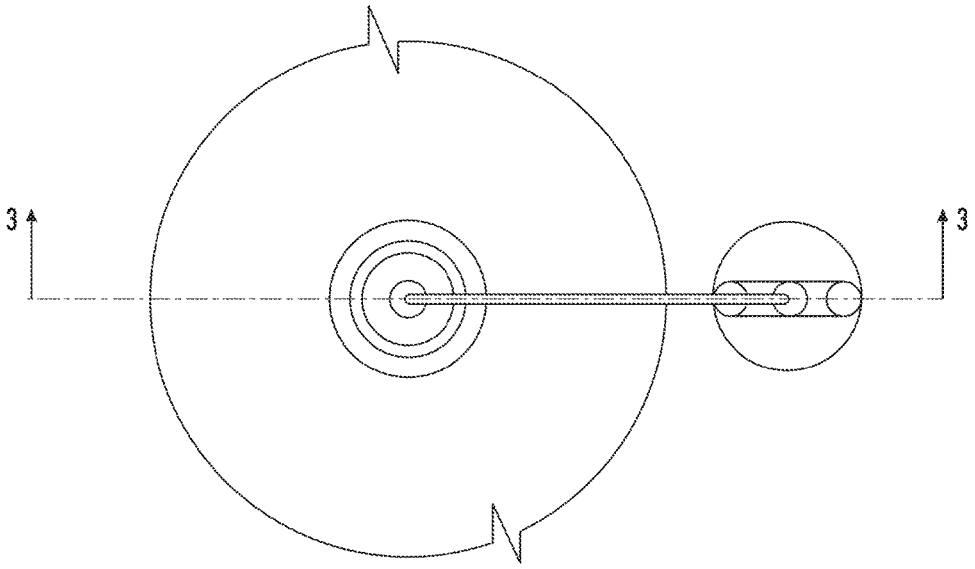
FIG. 4 is a view of a well killing device for a fractured formation without a safety pressure window according to an embodiment of the present invention.

As shown in FIG. 3, the first path 28 may further be provided with a killing manifold 4 used for regulating the discharge amount of the killing fluid discharged into the drilling column; a flow meter 6 used for displaying the discharge amount of the killing fluid discharged into the annulus; and a killing manifold branch valve 9 used for controlling the killing fluid to be discharged or stopped being discharged into the annulus through the first path 28. The pressure detector may comprises a casing pressure gauge 7, a piezoresistive pressure sensor, a ceramic pressure sensor, a diffusion silicon pressure sensor, a sapphire pressure sensor and a piezoelectric pressure sensor.

As shown in FIG. 3, the well killing device may further comprise: a second path 25 used for injecting the drilling fluid containing a plugging material into the drilling column 1; the controlling device is further used for controlling the drilling fluid containing a plugging material to inject into the fracture 17 of the formation 18 through the second path 25 under the circumstances where the drilling column 1 moves upward to the pre-determined position below the casing shoes 12. The second path 25 may be provided with a mud line branch valve 10 used for controlling the drilling fluid to be discharged or stopped being discharged into the drilling column 1 through the second path, a check valve 8 used for preventing the backflow of the killing fluid in the drilling column, and a flow meter 26 used for displaying the amount of drilling fluid discharged into the drilling column in real time.

As shown in FIG. 3, the well killing device may further comprise a third path 27 used for supplying the killing fluid to the first path 28 or supplying the drilling fluid to the second path 25. The first path 28, the second path 26 and the third path 27 are connected by way of a three-way control valve 11. The third path 27 may be provided with a fracturing train 20, a fluid supply truck 22, a mud pump 23 and a mud pool 24, wherein the mud pump 23 is respectively connected with the fluid supply truck 22 and the mud pool 24; when it is necessary to discharge the killing fluid into the annulus between the casing 3 and the drilling column 1, the killing manifold branch valve 9 is opened, and the killing fluid in the mud pool 24 is pumped into the fluid supply truck 22 and then discharged into the annulus through the killing manifold 4 upon a pressure rise of the fracturing train 20; when it is necessary to discharge the drilling fluid into the drilling column, the drilling fluid in the mud pool 24 is pumped into the fluid supply truck 22 by way of opening the mud line branch valve 10, and then discharged into the drilling column upon a pressure rise of the fracturing train 20. The third path 27 may be further provided with an instrument truck 21 which is respectively connected with the fracturing train 20 and the fluid supply truck 22 for the real-time monitoring of the pressure of the killing fluid or the drilling fluid as well as the relevant parameters such as emissions.

The flow regulating device can be a fluid injection pump which is mounted in the fracturing train. Any fracturing truck of the fracturing train may be provided with one fluid injection pump, and the controlling device may be configured to control the discharge amount of the killing fluid by way of regulating the pump strokes of the fluid injection pump. Alternatively, the first discharge amount $Q_1$ should satisfy the following relationship: $v_sA<Q_1<\mathrm{Min}\{Q_{11}, Q_{12}, Q_{13}, Q_{14}\}$, wherein A is the cross-sectional area of the annulus, $Q_{11}$ is the maximum discharge amount of the killing fluid allowed by the killing fluid injecting device at the wellhead; $Q_{12}$ is the maximum discharge amount of the killing fluid allowed by the fracture pressure of the casing shoes; $Q_{13}$ is the maximum discharge amount of the killing fluid allowed by the anti-internal pressure of the casing; $Q_{14}$ is the maximum discharge amount of the killing fluid allowed by the fracture pressure at the bottom of a well;

$$v_s = C\left[\frac{gD(\rho_L - \rho_g)}{\rho_L}\right]^{0.5},$$

is the slippage rising speed of the intruding gas of the formation in the killing fluid, wherein g is a gravitational acceleration, $\rho_L$ is the density of the killing fluid, $\rho_g$ is the density of the intruding gas of the formation, D is the hydraulic diameter of the annulus, and C is a constant.

Alternatively, the constant C can be calculated via a Barnea model, $$C = 0.1725[(\pi + 1) + K(\pi - 1)]^{0.5},\ K = \frac{D_{io}}{D_{ci}},$$

wherein $D_{to}$ is the outer diameter of the drilling column; $D_{ci}$ is the inner diameter of the casing.

Alternatively, the second discharge amount $Q_2$ satisfies the following relationship: $Q_2=Q_{21}+Q_{22}+Q_{23}$, wherein, $Q_{21}$ is the amount of the killing fluid to be replenished due to the upward movement of the drilling column which causes the fluid level in the annulus to be reduced; $Q_{22}$ is the amount of the killing fluid to be replenished due to the leakage of the killing fluid into the fracture of the formation; and $Q_{23}$ is the amount of the killing fluid to be replenished due to the twitching effect caused by the upward movement of the drilling column.

Alternatively, the $Q_{21}$ and the $Q_{23}$ are respectively determined by:

$$Q_{21} = \frac{1}{4}\pi D_{to}^2 v_p,\ Q_{23} = \frac{1}{2} f v_p^3 \frac{\pi(D_{ci} + D_{to})}{4g},$$

wherein $v_p$ is the rising speed of the drilling column; $D_{to}$ is the outer diameter of the drilling column; $D_{ci}$ is the inner diameter of the casing; f is a friction coefficient of the killing fluid; and the $Q_{22}$ is related to the viscosity $\mu_L$ of the killing fluid, the density ρ of the killing fluid, the width W of the fracture and the pressure difference Δp between the bottom of the well and the formation at the same level as the bottom of the well.

The controller may be a general purpose processor, a special purpose processor, a conventional processor, a digital signal processor (DSP), a plurality of microprocessors, one or more microprocessors associated with the DSP core, a controller, a microcontroller, an application specific integrated circuit (ASIC), a field programmable gate array (FPGA) circuit, any other type of integrated circuit (IC), state machine and the like.

Specifically, the well killing device shown in FIG. 3 is taken as an example to explain the well killing process for a fractured formation without a safety pressure window provided in the present invention.

First, the first discharge amount of the killing fluid is determined according to the density of the killing fluid and the invading gas, combined with the maximum discharge amount of the killing fluid which the well killing device can withstand under normal working conditions. The mud pump 23, the fluid supply truck 22 and the fracturing train 20 are started and the killing manifold branch valve 9 is opened to pump the killing fluid in the mud pool 24 into the fluid supply truck 22, and then the killing fluid is controlled to be discharged into the annulus by the first discharge amount through the killing manifold 4 by way of controlling the pump strokes of the fluid injecting pump (not shown) in each fracturing truck of the fracturing train 20 via a controlling device upon a pressure rise of the fracturing truck 20, so as to use the extruding action of the vertically downward flow of the killing fluid to change the direction of movement of the intruding fluid of the formation from upward movement to downward movement. The simultaneous steering of the direction of friction of the intruding gas during the process of steering of extrusion of the intruding gas results in the highest pressure at the wellhead at this time (the casing pressure of the annulus); therefore, it is necessary to monitor the pressure change of the casing pressure of the annulas in real time via a casing pressure gauge 7, to ensure that it does not exceed the pressure bearing capacity of the device at the wellhead and 80% of the anti-internal pressure bearing capacity of the casing.

Second, as the gas 15 invading the annulus is gradually pressed back into the formation 18, the killing fluid continues to be discharged into the annulus by the first discharge amount through the killing manifold 4, but the density of the fluid in the annulus gradually increases, that is, the pressure of the hydrostatic column increases, so the casing pressure of the annulus gradually reduces; it is necessary to monitor the change of the casing pressure of the annulus in real time via a casing pressure gauge 7 to determine the situation that the intruding gas 15 of the annulus is pressed back into the formation 18. In addition, if the back-pressure valve 16 is not installed in the drilling column or the back-pressure valve 16 is not tightly sealed, the intruding gas may also enter the drilling column 1. In this case, after the intruding gas in the annulus is pressed back into the formation, the intruding gas in the drilling column 1 can continue to be pressed back into the formation by way of the same method.

Then, as the killing fluid 13 with a higher density is gradually injected into the annulus, the intruding gas 15 and the contaminated drilling fluid 14 continue to be pressed back into the formation 18, and when the casing pressure gauge 7 shows that the casing pressure at the wellhead has been gradually reduced to a certain value and remains unchanged, it is considered that the gas kick is effectively controlled. If the discharge of the killing fluid is suddenly stopped at this time, since the flow of the killing fluid 13 has an inertia, the killing fluid will continue to flow into the formation, and the fluid level cannot be maintained at the wellhead in the annulus. The pressure at the bottom of the well (i.e., the lowest position where the driller body 19 is located) will be reduced with the leakage of the killing fluid 13, thus causing the recurrence of the gas kick; therefore, the braking should be gradually reduced, that is, the rate of injection of the fracturing train 20 should be gradually reduced until the injection is stopped, so as to reduce the leakage caused by the inertia of the killing fluid. The killing manifold branch valve 9, the mud pump 23, the fluid supply truck 22 and the fracturing truck train 20 are closed.

Then, after the killing fluid 13 successfully presses the formation intruding gas 15 back to the formation 18, the drilling column 1 is controlled to be lifted close to the casing shoes 12 (for example, 5 m below the casing shoes) for the preparation of injecting the drilling fluid containing a plugging material. During the process of the lifting of the drilling column 1, the reduction of the fluid level in the annulus, the leakage of the killing fluid 13 in the annulus and the twitching effect caused by the upward movement of the drilling column 1 will cause the pressure at the bottom of the well to reduce; therefore, the hanging irrigation and pressure stabilization is required to be conducted, that is, the drilling column is controlled to move upward alternately at a preset interval and the killing fluid is controlled to be discharged into the annulus by a second discharge amount to prevent the recurrence of gas kick. Specifically, the drilling column 1 is controlled to move upward by a rising speed $v_p$ during a time of $\Delta t_1$; during the time of $\Delta t_2$, the drilling column 1 is stopped to move upward, and the mud pump 23, the mud pump 23, the fluid supply truck 22 and the fracturing train 20 are started and the killing manifold branch valve 9 is opened to pump the killing fluid in the mud pool 24 into the fluid supply truck 22; the killing fluid is controlled to be discharged into the annulus by the second discharge amount through the killing manifold 4 by way of controlling the pump strokes of the fluid injecting pump (not shown) in each fracturing truck of the fracturing train 20 via a controlling device upon a pressure rise of the fracturing truck 20; and then the pump is stopped. The steps are repeated until the drilling column is lifted close to the casing shoes, wherein $\Delta t_1$ and $\Delta t_2$ may or may not be equal. In addition, a flow meter 6 can be used to monitor the discharge amount of the killing fluid 13 during the process of hanging irrigation and pressure stabilization in real time so as to make the discharge amount equal to the pre-set second discharge amount, and meanwhile the change of the casing pressure is monitored in real time via the casing pressure gauge 7 to ensure that the pressure at the bottom of the well remains unchanged during the lifting of the drilling column. After the drilling column 1 is lifted up to 5 m below the casing shoes 12, the killing manifold branch valve 9, the mud pump 23, the fluid supply truck 22 and the fracturing truck set 20 are closed.

Finally, the mud line branch valve 10 is opened, and the mud pump 23, the fluid supply truck 22 and the fracturing train 20 are opened; the drilling fluid containing a plugging material is injected into the fractured formation 18 through the third path 27, the second path 25 and the drilling column 1, and the plugging material enters the fracture 17 with the drilling fluid. The fracture 17 is blocked by the bridging action among the particles of the plugging material, and a safety pressure window is re-established, thus increasing the pressure bearing capacity of the fractured formation 18. After all the fractures 17 in the fractured formation 18 are blocked, the mud line branch valve 10 the mud pump 23, the fluid supply truck 22 and the fracturing train 20 are closed to complete the killing process, wherein, the top end of the casing 3 is further provided with a blowout preventer stack 2 used for preventing the fluid in the annulus from being ejected when an air spray occurs.

In summary, the present invention creatively controls the discharge amounts of the killing fluid at different stages of the killing according to a gas-fluid two-phase flow theory as well as the pressure of the killing fluid at the wellhead and the rising speed of the drilling column, so as to effectively reduce the safety risk during the well killing process for a fractured formation without a safety pressure window, thus providing safety for the killing operations.

In conclusion, the invention creatively controls the discharge amount of the killing fluid in different killing stages according to the gas-fluid two-phase flow theory, the pressure of the killing fluid at the wellhead, and the rising speed of the drilling column, so as to effectively reduce the safety risk in a well killing process for a fractured formation without a safety pressure window, thus providing safety for a killing operation.

The optional embodiment of example of implementation of the invention is described in detail by combining with the accompanying drawing abovementioned. However, the example of implementation of the invention is not limited to the specific details in the embodiment, within the technical design scope of the example of implementation of the invention, multiple simple transitions of the technical scheme of the example of implementation of the invention can be carried out, and these single transitions belong to the scope of protection of the example of implementation of the invention.

What needs to be explained additionally is that the specific technical features described in the embodiment can be combined through any suitable mode in the presence of no contradictions. In order to avoid unnecessary repetition, the example of implementation of the invention no longer illustrates various possible combined modes.

In addition, different embodiment of the example of implementation of the invention also can be combined randomly and shall be regarded as content disclosed by the example of implementation of the invention as long as the combination complies with the idea of the example of implementation of the invention.

Although features and elements are described above in particular combinations, one of ordinary skill in the art will appreciate that each feature or element can be used alone or in any combination with the other features and elements. In addition, the methods described herein may be implemented in a computer program, software, or firmware incorporated in a computer-readable medium for execution by a computer or processor. Examples of computer-readable storage media include, but are not limited to, a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs).

What is claimed is:

1. A well killing method for a fractured formation without a safety pressure window, comprising the following steps:

controlling a killing fluid to discharge into an annulus between a casing and a drilling column of a well killing device by a first discharge amount based on physical parameters of a intruding gas of the formation and physical parameters of the killing fluid, so that the intruding gas is turned downward by the killing fluid;

detecting and transmitting a pressure of the killing fluid at a wellhead in the annulus;

determining that the intruding gas is completely pressed back into the formation when the pressure of the killing fluid at the wellhead in the annulus is detected to remain unchanged, and controlling the killing fluid to stop discharging and the drilling column to move upward at a pre-set speed; and controlling the killing fluid to discharge into the annulus by a second discharge amount based on a rising speed of the drilling column during the process of upward movement of the drilling column, so as to maintain the pressure at the bottom of the well, wherein the second discharge amount $Q_2$ satisfies the following relationship: $Q_2=Q_{21}+Q_{22}+Q_{23}$, wherein, $Q_{21}$ is the amount of the killing fluid to be replenished due to an upward movement of the drilling column which causes fluid level in the annulus to be reduced; $Q_{22}$ is the amount of the killing fluid to be replenished due to a leakage of the killing fluid into the fracture of the formation; and $Q_{23}$ is an amount of the killing fluid to be replenished due to a twitching effect caused by the upward movement of the drilling column.

2. The well killing method for a fractured formation without a safety pressure window according to claim 1, wherein the controlling the killing fluid to stop discharging comprises:

controlling the discharge of the killing fluid to reduce by a pre-set regular discharge amount until the discharge is stopped.

3. The well killing method for a fractured formation without a safety pressure window according to claim 1, wherein the first discharge amount $Q_1$ satisfies the following relationship:

$$v_s A<Q_1<\mathrm{Min}\{Q_{11},Q_{12},Q_{13},Q_{14}\},$$

wherein A is a cross-sectional area of the annulus, Q11 is a maximum discharge amount of the killing fluid allowed by the killing fluid injecting device at the wellhead; Q12 is a maximum discharge amount of the killing fluid allowed by a fracture pressure of a casing shoes; Q13 is a maximum discharge amount of the killing fluid allowed by an anti-internal pressure of the casing; Q14 is a maximum discharge amount of the killing fluid allowed by the fracture pressure at the bottom of a well;

$$v_s = C\left[\frac{gD(\rho_L - \rho_g)}{\rho_L}\right]^{0.5},$$

is a slippage rising speed of the intruding gas of the formation in the killing fluid, wherein g is a gravitational acceleration, ρL is a density of the killing fluid, ρg is a density of the intruding gas of the formation, D is a hydraulic diameter of the annulus and C is a constant.

4. The well killing method for a fractured formation without a safety pressure window according to claim 3, wherein the constant C can be calculated via a Barnea model, $$C = 0.1725[(\pi + 1) + K(\pi - 1)]^{0.5},\ K = \frac{D_{to}}{D_{ci}},$$

wherein Dto is an outer diameter of the drilling column; Dci is an inner diameter of the casing.

5. The well killing method for a fractured formation without a safety pressure window according to claim 1, wherein the $Q_{21}$ and the $Q_{23}$ are respectively determined by:

$$Q_{21} = \frac{1}{4}\pi D_{to}^2 v_p,\ Q_{23} = \frac{1}{2} f v_p^3 \frac{\pi(D_{ci} + D_{to})}{4g},$$

wherein $v_p$ is the rising speed of the drilling column; $D_{to}$ is an outer diameter of the drilling column; $D_{ci}$ is an inner diameter of the casing; f is a friction coefficient of the killing fluid; and the $Q_{22}$ is related to a viscosity $\mu_L$ of the killing fluid, a density ρ of the killing fluid, a width W of the fracture and a pressure difference Δp between the bottom of a well and the formation at the same level as the bottom of the well.

6. The well killing method for a fractured formation without a safety pressure window according to claim 1, further comprising:

injecting a drilling fluid containing a plugging material into a fracture of the formation under the circumstances where the drilling column moves upward to a predetermined position below a casing shoes.

7. A well killing device for a fractured formation without a safety pressure window, comprising a drilling column and a casing, with an annulus formed between the casing and the drilling column, wherein the well killing device further comprises:

a first path for injecting killing fluid into the annulus;

a flow regulating device for controlling a discharge amount of the killing fluid;

a pressure detector for detecting and transmitting a pressure of the killing fluid at the wellhead in the annulus;

a controlling device for performing the following operations:

controlling the flow regulating device to discharge the killing fluid into the annulus by a first discharge amount through the first path based on physical parameters of a intruding gas of the formation and physical parameters of the killing fluid, so that the intruding gas is turned downward by the killing fluid;

determining that the intruding gas is completely pressed back to the formation when the pressure of the killing fluid at the wellhead in the annulus is detected to remain unchanged, and controlling the killing fluid to stop discharging and the drilling column to move upward at a pre-set speed;

controlling the killing fluid to discharge into the annulus by a second discharge amount based on a rising speed of the drilling column during the process of upward movement of the drilling column, so as to maintain the pressure at the bottom of the well, wherein the second discharge amount $Q_2$ satisfies the following relationship: $Q_2=Q_{21}+Q_{22}+Q_{23}$, wherein, $Q_{21}$ is the amount of the killing fluid to be replenished due to an upward movement of the drilling column which causes fluid level in the annulus to be reduced; $Q_{22}$ is the amount of the killing fluid to be replenished due to a leakage of the killing fluid into the fracture of the formation; and $Q_{23}$ is an amount of the killing fluid to be replenished due to a twitching effect caused by the upward movement of the drilling column.

8. The well killing device for a fractured formation without a safety pressure window according to claim 7, wherein the controlling device is further used for controlling the flow regulating device to reduce the discharge amount of the killing fluid by a pre-set regular discharge amount until the discharge is stopped.

9. The well killing device for a fractured formation without a safety pressure window according to claim 7, wherein the first discharge amount $Q_1$ should satisfy the following relationship:

$$v_s A < Q_1 < \mathrm{Min}\{Q_{11}, Q_{12}, Q_{13}, Q_{14}\},$$

wherein A is a cross-sectional area of the annulus, Q11 is a maximum discharge amount of the killing fluid allowed by the killing fluid injecting device at the wellhead; Q12 is a maximum discharge amount of the killing fluid allowed by a fracture pressure of a casing shoes; Q13 is a maximum discharge amount of the killing fluid allowed by an anti-internal pressure of the casing; Q14 is a maximum discharge amount of the killing fluid allowed by the fracture pressure at the bottom of a well;

$$v_s = C\left[\frac{gD(\rho_L - \rho_g)}{\rho_L}\right]^{0.5},$$

is a slippage rising speed of the intruding gas of the formation in the killing fluid, wherein g is a gravitational acceleration, $\rho_L$ is a density of the killing fluid, ρg is a density of the intruding gas of the formation, D is a hydraulic diameter of the annulus and C is a constant.

10. The well killing device for a fractured formation without a safety pressure window according to claim 9, wherein the constant C can be calculated via a Barnea model, $$C = 0.1725[(\pi + 1) + K(\pi - 1)]^{0.5},\ K = \frac{D_{to}}{D_{ci}},$$

wherein Dto is an outer diameter of the drilling column; Dci is an inner diameter of the casing.

11. The well killing device for a fractured formation without a safety pressure window according to claim 7, wherein the Q21 and the Q23 are respectively determined by:

$$Q_{21} = \frac{1}{4}\pi D_{to}^2 v_p,\ Q_{23} = \frac{1}{2} f v_p^3 \frac{\pi(D_{ci} + D_{to})}{4g},$$

wherein vp is the rising speed of the drilling column; Dto is an outer diameter of the drilling column; Dci is an inner diameter of the casing; f is a friction coefficient of the killing fluid; and the Q22 is related to a viscosity ρL of the killing fluid, a density ρ of the killing fluid, a width W of the fracture and a pressure difference Δp between the bottom of a well and the formation at the same level as the bottom of the well.

12. The well killing device for a fractured formation without a safety pressure window according to claim 7, wherein, further comprising:

a second path used for injecting a drilling fluid containing a plugging material into the drilling column;

the controlling device is further used for controlling the drilling fluid containing a plugging material to inject into a fracture of the formation on condition that the drilling column moves upward to a pre-determined position below a casing shoes.

13. The well killing device for a fractured formation without a safety pressure window according to claim 7, wherein the flow regulating device is a fluid injection pump, and the controlling device is further used for controlling the discharge amount of the killing fluid by way of regulating the pump strokes of the fluid injection pump.

* * * * *